US006979235B2

(12) United States Patent
Lappöhn

(10) Patent No.: US 6,979,235 B2
(45) Date of Patent: Dec. 27, 2005

(54) ELECTRICAL PLUG-IN CONNECTOR WITH A HOUSING AND A HIGH-CURRENT CONTACT

(75) Inventor: Jürgen Lappöhn, Gammelshausen (DE)

(73) Assignee: ERNI Elektroapparate GmbH, Adelberg (DE)

( * ) Notice: Subject to any disclaimer, the term of this patent is extended or adjusted under 35 U.S.C. 154(b) by 0 days.

(21) Appl. No.: 10/732,122

(22) Filed: Dec. 10, 2003

(65) Prior Publication Data

US 2004/0171314 A1 Sep. 2, 2004

(30) Foreign Application Priority Data

Dec. 10, 2002 (DE) ..... 102 57 759

(51) Int. Cl.[7] ..... H01R 13/40
(52) U.S. Cl. ..... 439/733.1; 439/746; 439/744; 439/748; 439/851; 439/79
(58) Field of Search ..... 439/744, 733.1, 439/80, 748, 851, 79, 746

(56) References Cited

U.S. PATENT DOCUMENTS 5,046,952 A * 9/1991 Cohen et al. ..... 439/63
5,376,012 A * 12/1994 Clark ..... 439/80
5,389,013 A * 2/1995 Kourimsky ..... 439/746
5,658,175 A * 8/1997 Muzslay ..... 439/852
6,190,215 B1 * 2/2001 Pendleton et al. ..... 439/853

FOREIGN PATENT DOCUMENTS

DE 693 21 708 3/1999

* cited by examiner

*Primary Examiner*—Tho D. Ta
(74) *Attorney, Agent, or Firm*—Collard & Roe, P.C.

(57) ABSTRACT

An electrical plug-in connector consists of a housing and a high-current socket. The high-current socket is formed by a contact segment consisting of contact tongues, an intermediate segment, and an attachment segment, whereby the material thickness of the attachment segment is greater than the material thickness of the intermediate segment and the contact segment. A counter-contact surface for interaction with this change in the material thickness, which is configured in the form of a step, is provided in the housing. Furthermore, the high-current socket is fixed in place in the housing by means of resilient tongues on the intermediate segment, and a catch projection in the recess in the housing.

8 Claims, 5 Drawing Sheets

Fig 4a (45° cross section in lengthwise axis)

ELECTRICAL PLUG-IN CONNECTOR WITH A HOUSING AND A HIGH-CURRENT CONTACT

BACKGROUND OF THE INVENTION

1. Field of the Invention

This invention relates to an electrical plug-in connector with an insulating housing having a recess and a high current socket arranged in the recess. The socket has a contact segment, an intermediate segment and an attachment segment which are formed in one piece from a material cut-out.

2. The Prior Art

Such plug-in connectors are used, in particular, in order to obtain electrical contacts for high current flows, i.e. flows having a large ampere count. For this purpose, electrically conductive plugs in the form of pins are introduced into the contact segment of a high-current socket of this plug-in connector, in order to obtain an electrically conductive connection with other components, by way of the high-current socket.

The high-current socket is inserted into a recess of a housing that surrounds and insulates the high-current socket, i.e. into the corpus of the housing, and usually fixed in place in it. For this purpose, the high-current socket is introduced through the opening of the recess, into the recess, and attached by means of a catch connection, for example.

The high-current socket is subdivided into three segments, which are configured in one piece with one another during production of the high-current socket. The first segment is a contact segment, at which the actual electrical connection with another plug/pin takes place. The contact segment consists of several particularly resilient tongues, between which the pin is introduced. The second segment is the intermediate segment, on which the elastic spring tongues are formed, in order to make the catch connection in the surrounding housing, as described above, possible. The third segment is the attachment segment, with which the high-current socket together with the housing of the electrical plug-in connector can be attached to other components, preferably printed circuit boards, cards, or the like.

The high-current sockets are punched from a flat metal plate, the punching taking place in the shape that is desired for the high-current socket later. Suitable metallic materials that conduct the current well are known to a person skilled in the art. Subsequently, this flat metal cutout is rolled around a mandrel, for example, or pressed onto a mandrel, in order to essentially receive the external shape of a hollow cylinder, viewed in the axial expanse of the high-current socket. In this, the contact segment and the intermediate segment are bent towards one another to approximately form a closed cylinder shape, and the attachment segment is merely bent around to form a half circle or three-quarters circle, so that lateral regions of the attachment segment project essentially perpendicular to the lengthwise expanse of the high-current socket, in order to allow a connection with other components by means of these regions.

German Patent No. DE 693 21 708 T2 describes such an electrical plug-in connector, whereby here, a bend in the contact tongues is provided at the contact tongues of the contact segment, for clamping the related pin of the electrical connector in place, near the free ends of the contact tongues, in order to surround this pin. Furthermore, installation legs are provided on the attachment segment, with which the high-current socket can be attached to another base. Oblong centering guide elements are formed in one piece with the housing, in the interior of the recess of the housing that surrounds this high-current socket, with which guidance of the contact tongues of the contact segment in the recess takes place. Furthermore, catch projections are formed in the recess, which interact with catch tongues on the high-current socket, in order to attach the latter in the housing. Fixation in the axial lengthwise expanse of the cavity socket, relative to the housing, takes place here only in a lengthwise direction. Inserting the cavity socket into the housing too far is not avoided here.

SUMMARY OF THE INVENTION

It is therefore an object of the invention to provide an electrical plug-in connector having a housing and a high-current socket so that the production of the high-current socket and, in particular, the contact tongues is simplified, damage to the contact tongues during introduction into the housing is avoided, and the alignment in the lengthwise expanse of the high-current socket relative to the housing can be fixed in the desired position.

According to the invention, this task is accomplished by means of an electrical plug-in connector, comprising an insulating housing having a recess and a high-current socket arranged in the recess, said socket having a contact segment formed by several contact tongues, an intermediate segment, and an attachment segment. The segments are formed in one piece with one another from a material cut-out. A resilient tongue for fixing the high-current socket in place in the surrounding housing is disposed on the intermediate segment. There are devices on the attachment segment for attaching the high-current socket to another component, the devices having a plug/pin that can be inserted into the high-current socket. A guide projection is formed on the attachment segment, and a guide groove is formed on the housing, in the region of an opening of the recess. A material thickness (t2) of the attachment segment is greater than a material thickness (t1) of the intermediate segment and the contact segment, and a counter-contact surface is formed on the housing.

The core idea of the invention consists of the fact that a guide/alignment of the high-current socket relative to the housing takes place not using guide devices in the interior of the recess, but rather using guide devices that are arranged in the region of the opening of the recess, particularly outside of/in front of the recess. This prevents the elastic contact tongues from being bent by the guide devices arranged in the recess if the high-current socket is not inserted into the recess correctly, and thereby the high-current socket and/or the entire plug-in connector becomes unusable. By means of the guide devices that are already arranged in the region of the opening of the recess in the housing of the electrical plug-in connector, the contact tongues are already arranged in the recess in the correct position for further insertion. The resilient tongues on the intermediate segment are preferably obtained via flat embossing, in order to obtain a continuous reduction in cross-section and thereby a better spring effect.

In addition, the high-current socket, i.e. the material cut-out from which the high-current socket is produced, is configured in such a manner that the material thickness of the attachment segment is greater than the material thicknesses of the intermediate and contact segments. In this way, a step-like transition between the material thicknesses is obtained in the region between the intermediate segment and the attachment segment. This step serves as a contact surface, which interacts with a counter-contact surface in the recess of the housing of the electrical plug-in connector.

This means that the high-current socket can be inserted into the recess in the corpus of the housing only so far until the contact surfaces rest directly against one another. If the position along the lengthwise expanse of the high-current socket and the reciprocal distance between adjacent high-current sockets in the lengthwise expanse, viewed between the spring tongue on the intermediate segment and the contact surface between the intermediate segment and the attachment segment, as well as between the counter-contact surface in the corpus of the housing and another contact surface for the spring tongue on the intermediate segment are chosen appropriately, the high-current socket can be fixed in place in the housing in the desired position in the axial direction. This means that the depth to which the high-current socket is introduced into the housing can be selected and adjusted in desired manner.

For this purpose, the housing of the electrical plug-in connector consists of an insulating material, e.g. an injection-molded part made of a suitable plastic, as it is known to a person skilled in the art, which forms a corpus. A recess is provided in the corpus, into which the high-current socket can be inserted through the opening of the recess. Catch projections are formed in the recess, in known manner, which interact with the spring tongues on the intermediate segment of the high-current socket, as described above, in order to prevent the high-current socket from being pulled out of the recess again.

To align the high-current socket relative to the housing, guide grooves are formed on the housing, in the region of the opening in the corpus, in which guide projections correspondingly formed in the high-current socket can be brought into engagement, so that the high-current socket is aligned in the correct position even before the contact tongues are inserted, and bending of the contact tongues is avoided. Furthermore, the corpus has a counter-contact surface that interacts with the contact surface that is formed by means of the change in the material thickness of the high-current socket, in order to limit the depth to which the high-current socket is introduced into the recess. In this way, the axial position of the high-current socket can be fixed in place in the housing, together with the catch projections and spring tongues described above, in desired manner. The housing itself can be connected with other components, such as printed circuit boards or cards, by means of additional attachment devices, such as press-in pins, for example.

To guarantee a permanent and reliable electrical contact between the resilient contact tongues and the pin described above, it is proposed that additional projections or a projection that runs continuously in the recess is/are formed in the interior of the recess in the corpus of the housing. These can serve, for one thing, to limit the depth to which the high-current socket is pushed into the recess, in that the contact tongues butt up against the projection. For another thing, the projections can also be configured as a continuous reduction in the cross-section of the recess, so that the contact tongues are pressed uniformly towards one another, i.e. inward in the radial direction, by the narrowing cross-section, in order to thereby clamp a pin for the production of an electrically conductive connection in place, and provide a reliable contact. For this purpose, slits are formed between adjacent contact tongues when they are punched. Using such a projection, pre-centering of the pin that is to be pushed into the housing from the other side can also serve to prevent damage to the contact tongues.

The high-current socket has a guide projection on the attachment segment, by means of which the high-current socket can be aligned in the correct position relative to the recess in the corpus of the housing. Furthermore, a step-like increase in the material thickness of the cutout from which the high-current socket is obtained is formed at the transition from the intermediate segment to the attachment segment. This step serves as a contact surface that interacts with the counter-contact surface in the housing as described above. Such a step in the material cutout can be obtained, for example, in that the thickness of the attachment segment of the material cutout is reduced by a milling process, in those regions that form the subsequent intermediate and contact segments. Subsequently, the punching process and the deformation process can take place.

Preferably, the contact tongues are configured to run straight, i.e. in a straight line over their lengthwise expanse, in each instance, which means that they have no bends or kinks when viewed in the lengthwise direction, so that their production is possible by means of a single deformation of a flat material cutout to form a high-current socket.

In an advantageous further development of the invention, several guide projections are formed on the attachment segment, for example two, which are formed on opposite sides of the attachment segment. A corresponding structure of the housing, with a corresponding number and arrangement of the guide grooves, is then also advantageous.

Attachment of the attachment segment to other components, particularly printed circuit boards or cards, can take place in simple manner in that the attachment device is structured either as solder pins that are soldered to the components, or as a press-in zone, i.e. that this part of the attachment segment and a correspondingly structured segment of the other component are pressed together, in order to obtain a permanent connection. Furthermore, the attachment device can be structured as an SMD contact region.

For permanent contacting of an electrical pin, it is furthermore proposed that the contact tongues are inclined towards one another towards their free ends, so that the clear width of the cavity socket is reduced towards the free end. In this way, the electrical pin can be clamped in place. This incline can either be pre-set during production of the cavity socket, by means of corresponding deformation processes, or is obtained by means of a correspondingly structured recess in the corpus of the housing, the cross-section of which is reduced.

In order to facilitate introduction of the pin into the cavity socket, the free ends of the contact tongues are provided with inclined surfaces that jointly form a conically widened region.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views:

FIG. 4*a*, 4*b*: a high-current socket in cross-section and in a perspective view.

DETAILED DESCRIPTION OF THE PREFERRED EMBODIMENT

Figure 1:
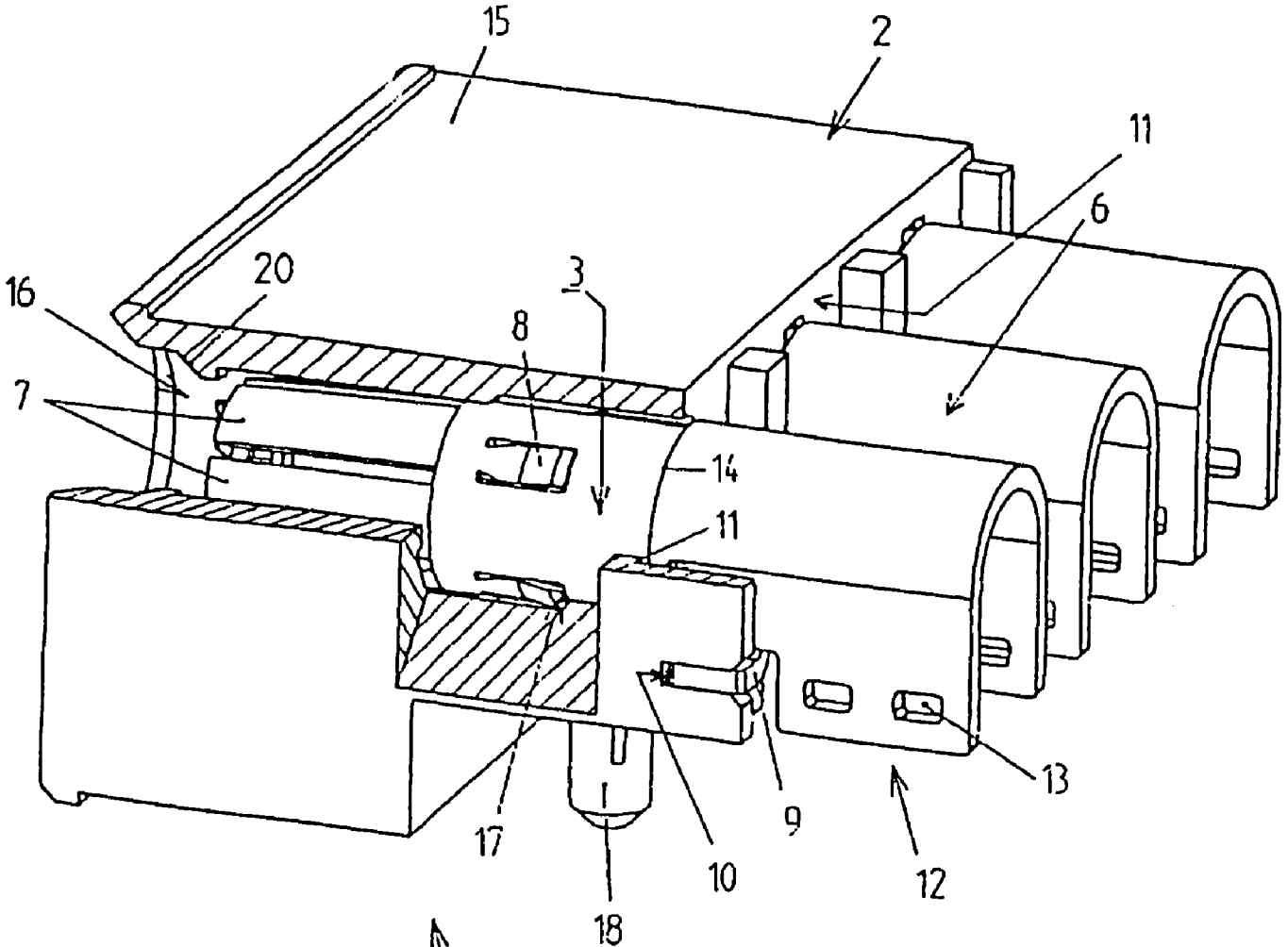
FIG. 1: an electrical plug-in connector in a partially cut-away view.
Figure 2:
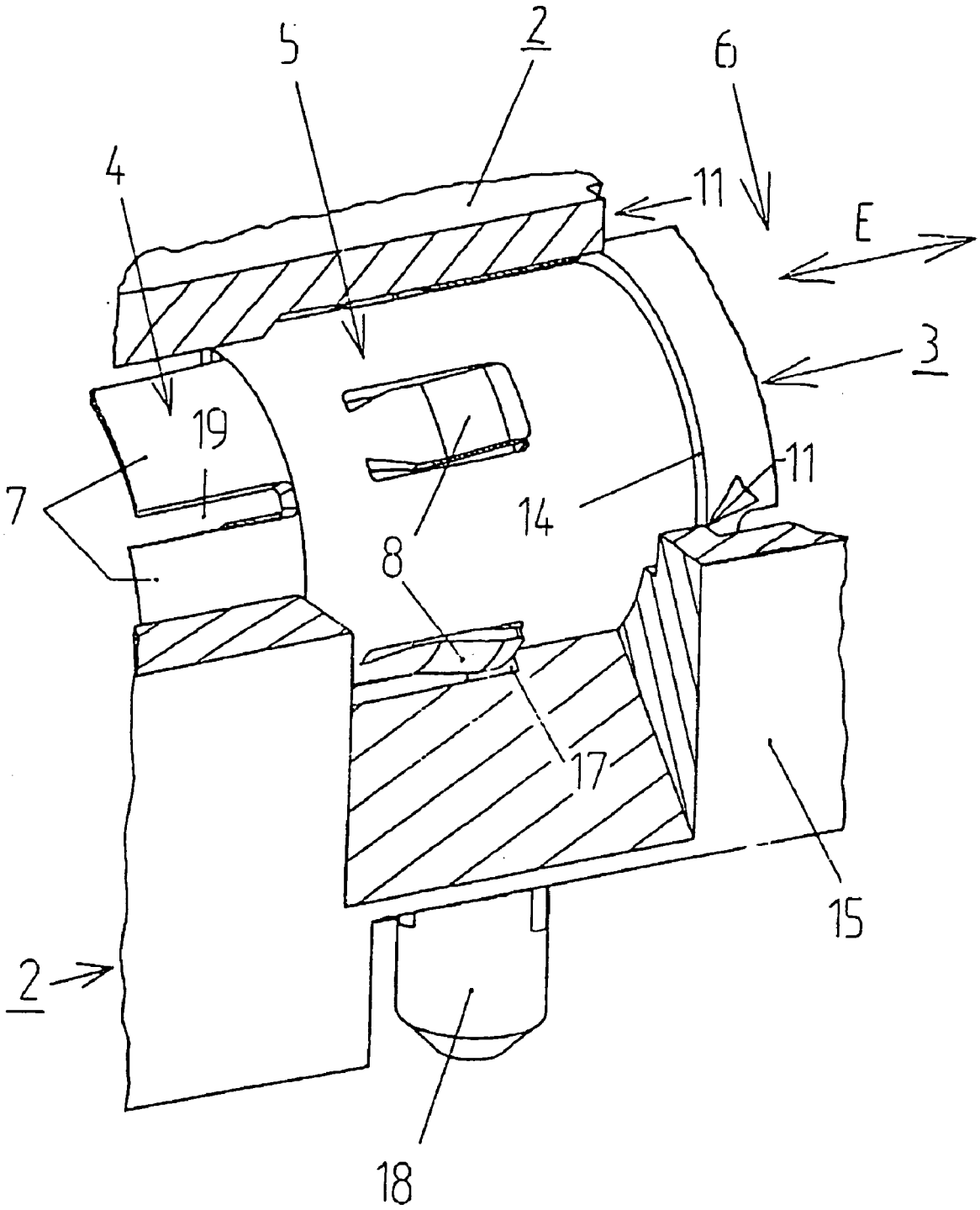
FIG. 2: a high-current socket pushed into a housing, in a cut-away view.
Figure 3:
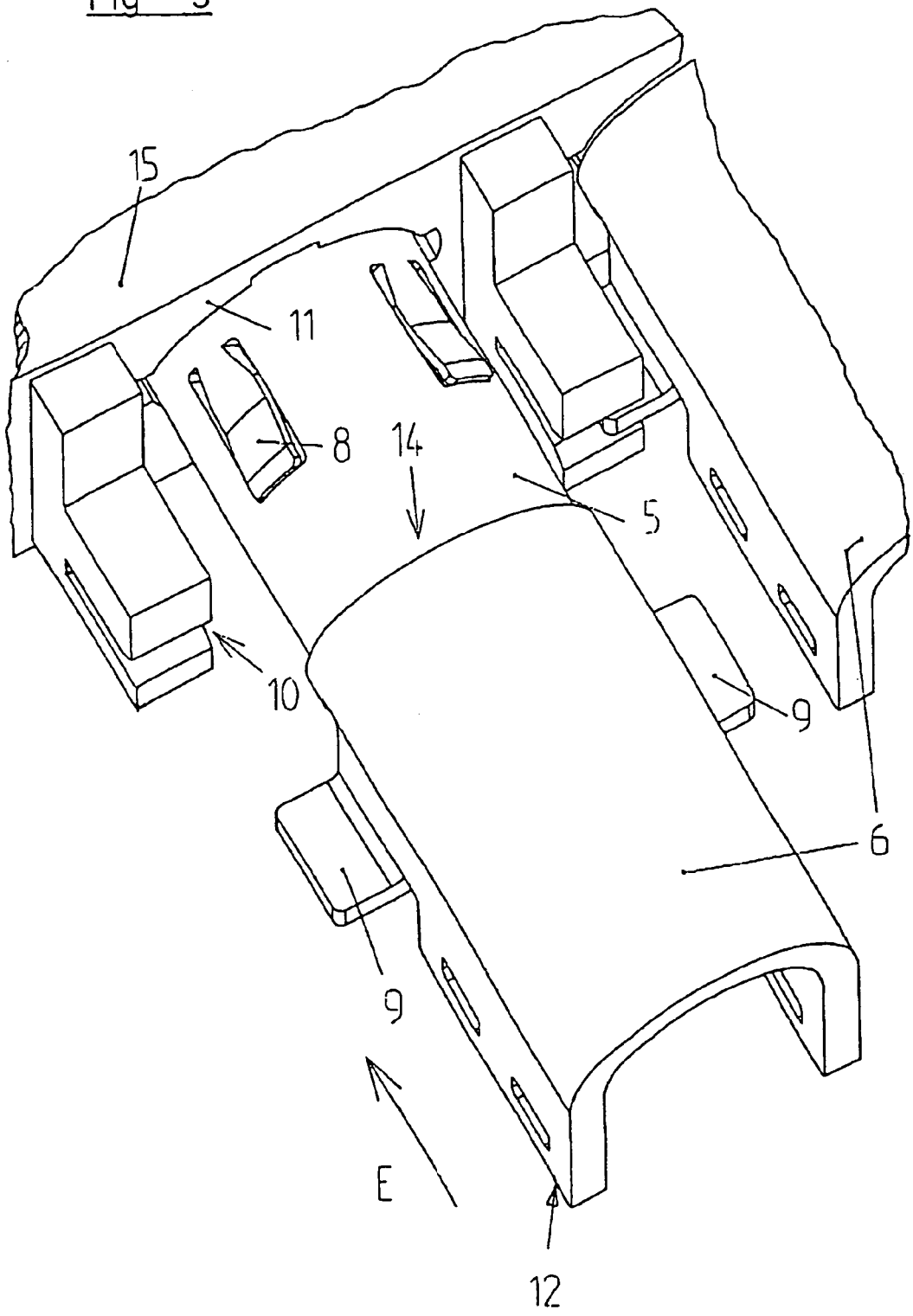
FIG. 3: a high-current socket during insertion into a housing.
Figure 4B:
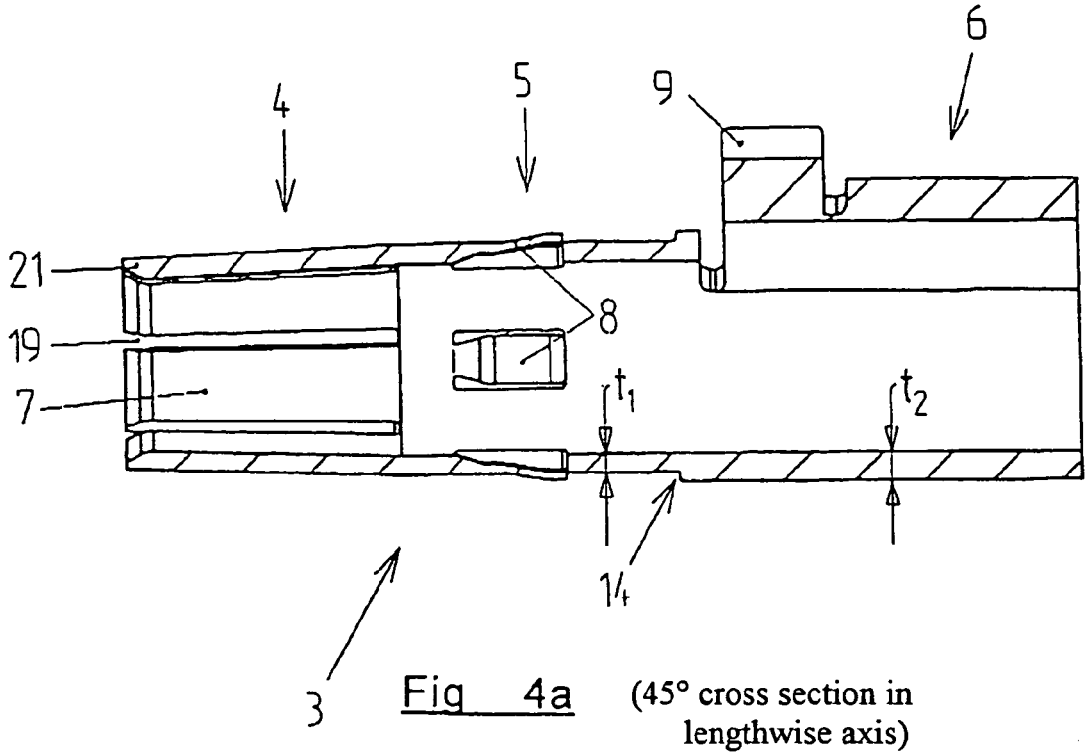
Figure 4B:
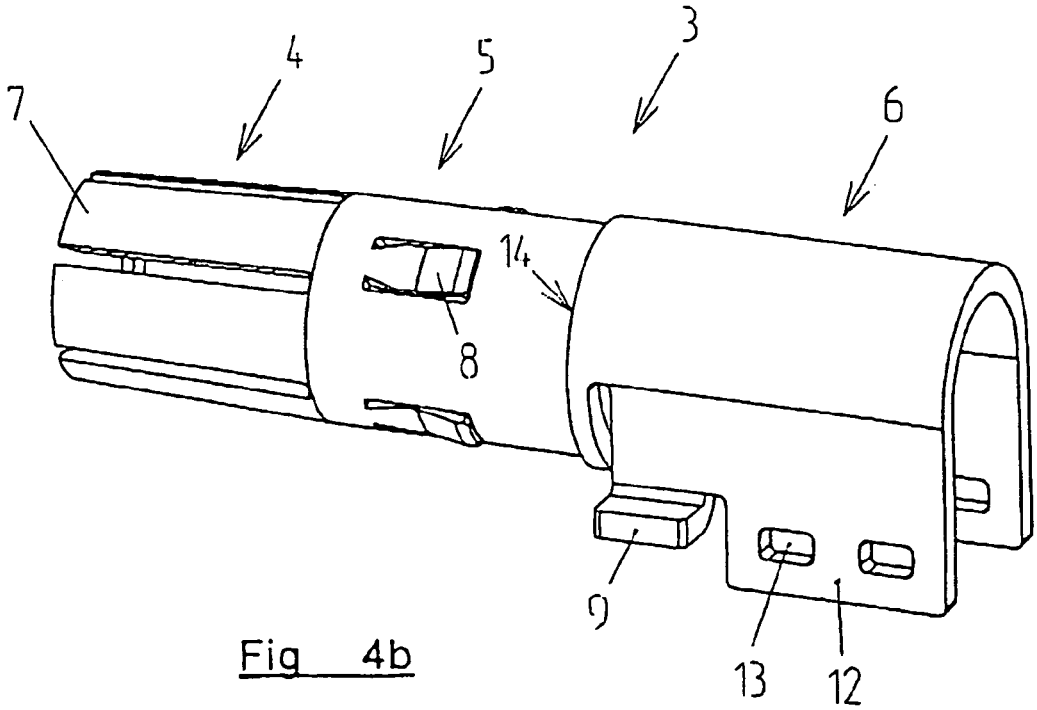

Referring now in detail to the drawings and, in particular, the exemplary embodiment of the invention presented in FIGS. 1, 2, 3, 4*a*, and 4*b* is an electrical plug-in connector 1 consisting of a housing 2 and a high-current socket 3. The housing 2 is formed by a corpus 15, for example a plastic injection-molded part. A recess 16 in the form of a break-through is formed in corpus 15. Metallic high-current socket 3 is introduced into corpus 15 from one side, in the insertion direction E. In order to produce an electrical connection, a plug/pin, (not shown), is inserted into recess 16 from the left, and contacted by contact tongues 7.

In order to align high-current socket 3 in the correct position relative to corpus 15, guide projections 9 are formed on attachment segment 6 of high-current socket 3, which interact with guide grooves 10 on corpus 15. In this, guide grooves 10 are arranged outside of/in front of the opening of recess 16, in order to already align the high-current socket during its introduction.

Spring tongues 8, which are formed on intermediate segment 5 and project beyond intermediate segment 5 in the radial direction, and interact with catch projections 17 in the interior of recess 16 in a known manner, fix the axial position of high-current socket 3 in place in recess 16. Spring tongues 8 are preferably flat and embossed. A step 14 on high-current socket 3, which interacts with a counter-contact surface 11 on housing 2, i.e. in recess 16 of corpus 15, serves for fixation in the opposite direction. Due to this fixation in both axial directions of the lengthwise expanse of high-current socket 3, socket 3 can be fixed in place in housing 2, in the desired position, without play.

Step 14, as is evident from FIG. 4*a*, is obtained via a change in the material thickness t1 of intermediate segment 5 and contact segment 4 as compared with material thickness t2 of attachment segment 6. This step 14 can be obtained, for example, before high-current socket 3 is punched/formed, by means of milling down the material cutout.

The contact segment 4 is formed by several, preferably resilient contact tongues 7, which have an inclined surface 21 at their free ends, so that conical widening is facilitated at this free end of contact segment 4, to facilitate the insertion of an electrical pin from the other side of recess 16, into electrical plug-in connector 1.

Preferably, several high-current sockets 3 are arranged next to and/or above one another, in a housing 2, in order to obtain a plurality of electrical contacts.

In this embodiment, an SMD contact region 12, which is formed in attachment segment 6 with break-throughs 13, attaches the electrical plug-in connector 1, i.e. attachment segment 6 to other components, such as printed circuit boards or cards. The SMD contact region 12 is configured in a known manner. Break-throughs 13 are necessary in order to avoid the solder tin from spreading out over the entire contact during soldering. However, solder pins or a press-in zone on attachment segment 6 can also serve for the attachment.

Additional attachment devices 18, for example a press-in pin, can also be provided on housing 2, in order to connect the housing 2 itself with other components.

As is evident from FIG. 1, additional projections 20, or a continuous collar-shaped projection 20 around the circumference, is/are formed in the interior of the recess 16. This can then serve to limit the insertion depth of high-current socket 3 into housing 2, in that contact tongues 7 come to rest against it. Such a projection 20, if it is configured in the form of a continuous reduction in cross-section of the recess 16, can incline the spring tongues 7 towards one another, as is evident from the cross-sectional diagram of FIG. 4*a*, towards their free ends, in each instance, so that the clear width of the high-current socket 3 is reduced towards its free end. Thereby electrical pins can be clamped in place in high-current socket 3 by contact tongues 7. For this purpose, slits 19 obtained by punching are provided between contact tongues 7.

However, projection 20 can also be configured so that it has an inclined surface on a side that faces the pin to be introduced, in order to act as a centering mechanism for the pin in this manner, in order to prevent damage to the contact tongues 7.

All of the characteristics mentioned in the above description, as well as those that are evident solely from the drawings, are additional integral parts of the invention, even if they are not specifically emphasized and mentioned in the claims.

Figure 5:
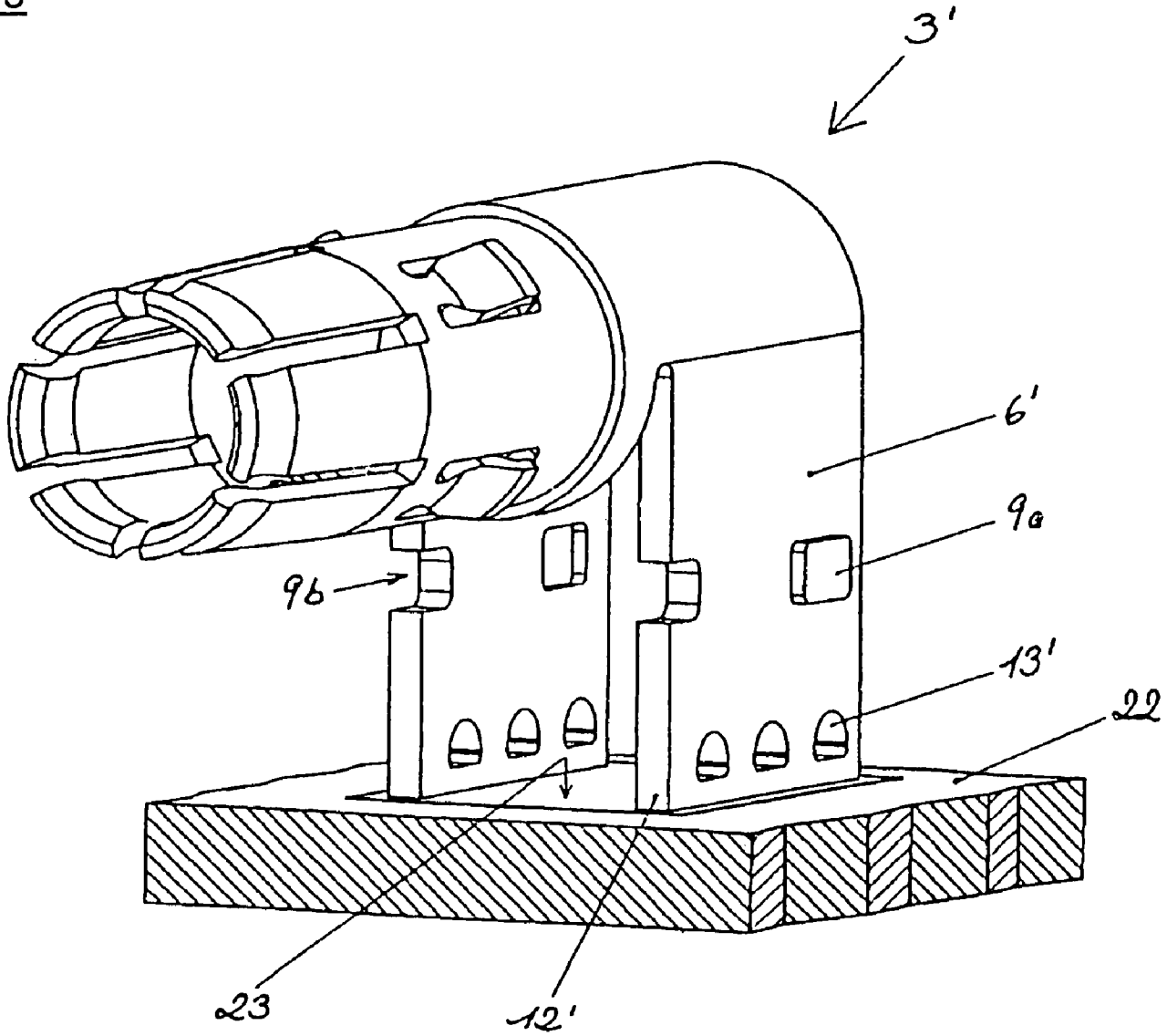
FIG. 5: another embodiment of the high-current socket in a perspective view.

The invention is not restricted to the exemplary embodiment, but rather can be varied in many different ways, within the scope of the disclosure. For example, FIG. 5 shows an exemplary embodiment in which the transition segment 6' of the attachment segment 6 of the current socket 3', which faces the contact region 12', has another embodiment variant. As compared with the high-current socket 3 shown in FIGS. 1 to 4*b*, the high-current socket 3' shown in FIG. 5 has a different structure, in certain details. In this embodiment, a guide groove 9*b* is worked into every transition segment 6' of the attachment segment 6 that is provided and faces towards the contact region 12', on the face, in other words pointing in the direction of the intermediate segment 5. In addition, a guide projection 9*a* is provided in the rear segment, in each instance, to the side, at approximately the same height as the guide groove 9*b*. The guide groove 9*b*and the guide projection 9*a* have the same function as the guide projection 9 in the embodiment variant according to FIGS. 1 to 4*b*.

The guide projection 9*a* lies in the guide groove 10 of the housing 2 in the assembled state. The guide groove 8*b* on the attachment segment 6 of the high-current socket 3' overlaps a journal arranged on the counter-contact surface 11 of the housing 2, not shown in the drawing.

In this perspective representation, the two SMD contact regions 12' are set onto a card 22; 23 refers to the related solder area on the card 22. The break-throughs with regard to influencing the solder tin are referred to as 13' here.

This embodiment variant of a high-current socket will particularly be used if the structural length in the axial direction, in other words viewed in the plug-in direction, must be kept short, and the height of the plug-in connector, in other words the height of the attachment segment, can be more variable.

Accordingly, while only a few embodiments of the present invention have been shown and described, it is obvious that many changes and modifications may be made thereunto without departing from the spirit and scope of the invention.

| Reference Symbol List | |
|---|---|
| 1 | electrical plug-in connector |
| 2 | housing of Item 1 |
| 3, 3' | high-current socket of Item 1 |
| 4 | contact segment of Item 3 |
| 5 | intermediate segment of Item 3 |
| 6 | attachment segment of Item 3 |
| 6' | transition segment of Item 3' |
| 7 | contact tongue of Item 4 |
| 8 | tongue on Item 5 |
| 9 | guide projection on Item 6 |
| 9a | guide projection on Item 6' |
| 9b | guide groove on Item 6' |
| 10 | guide groove on Item 2 |
| 11 | counter-contact surface on Item 2 |
| 12, 12' | SMD contact region on Item 6 |
| 13, 13' | break-through in Item 12 |
| 14 | step on Item 3 |
| 15 | corpus of Item 2 |
| 16 | recess in Item 15 |
| 17 | catch projection on Item 16 |
| 18 | attachment device on Item 2 |
| 19 | slits between Items 7 |
| 20 | projection in Item 16 |
| 21 | inclined surface on Item 7 |
| 22 | card |
| 23 | solder area |
| F | insertion direction of Item 3 into Item 2 |
| t1, t2 | material thicknesses of Item 3 |

What is claimed is:

1. A high-current socket for an electrical plug-in connection that has an insulating housing for accommodating the socket, said socket comprising:

a contact segment formed by several resilient contact tongues;

an intermediate segment having a resilient tongue that projects slightly radially away from said socket;

an attachment segment having devices for attaching the high-current socket to another component and a guide projections formed on the attachment segment, said projections interacting with guide grooves disposed outside of the housing to align the socket in the housing;

wherein said segments are formed in one piece with one another from a material cut-out; and wherein a material thickness (t2) of the attachment segment is greater than a material thickness (t1) of the intermediate segment and the contact segment, thereby forming a step, which fixes an axial position of the socket in the housing when the socket is inserted into the housing.

2. A high-current socket according to claim 1, wherein the contact tongues are straight over a lengthwise expanse and have no kinks.

3. A high-current socket according to claim 1, wherein several guide projections are formed on the attachment segment.

4. A high-current socket according to claim 1, wherein the contact tongues are straight over a lengthwise expanse and have no kinks, and wherein several guide projections are formed on the attachment segment.

5. A high-current socket according to claim 1, wherein the devices on the attachment segment are solder pins, a press-in zone, or an SMD contact region.

6. A high-current socket according to claim 1, wherein the contact tongues are uniformly inclined towards one another towards their free ends.

7. A high-current socket according to claim 1, wherein the contact tongues have a conical widening at their free ends.

8. A high-current socket according to claim 1, wherein the tongues on the intermediate segment are flat and embossed.

* * * * *